US009305763B2

(12) United States Patent
Kim et al.

(10) Patent No.: US 9,305,763 B2
(45) Date of Patent: Apr. 5, 2016

(54) LIGHTING APPARATUS

(71) Applicant: LG ELECTRONICS INC., Seoul (KR)

(72) Inventors: Donghun Kim, Seoul (KR); Hyunjung Kim, Seoul (KR); Junsung Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 236 days.

(21) Appl. No.: 14/075,887

(22) Filed: Nov. 8, 2013

(65) Prior Publication Data

US 2014/0132152 A1 May 15, 2014

(30) Foreign Application Priority Data

Nov. 12, 2012 (KR) ..... 10-2012-0127116

(51) Int. Cl.
*H01J 65/04* (2006.01)
*H01J 61/02* (2006.01)

(52) U.S. Cl.
CPC ..... *H01J 65/044* (2013.01); *H01J 61/025* (2013.01)

(58) Field of Classification Search
None
See application file for complete search history.

(56) References Cited

U.S. PATENT DOCUMENTS 7,081,707 B2 * 7/2006 Lee ..... H01P 5/02 315/39
7,795,815 B2 * 9/2010 Takada ..... H01J 65/044 315/39
8,089,203 B2 * 1/2012 Neate ..... H01J 65/044 313/160
8,102,123 B2 * 1/2012 Espiau ..... H01J 65/042 315/111.01
8,405,291 B2 * 3/2013 Preston ..... H01J 65/044 313/110
8,461,751 B2 * 6/2013 Neate ..... H01J 65/044 313/160
8,814,620 B2 * 8/2014 Pothoven ..... B32B 33/00 313/231.71
8,884,518 B2 * 11/2014 Espiau ..... H01J 65/042 315/248
2003/0098639 A1 * 5/2003 Hea ..... H01J 65/044 313/113
2010/0148669 A1 * 6/2010 DeVincentis ..... H01J 65/046 315/34
2010/0270920 A1 * 10/2010 Neate ..... H01J 65/044 313/607
2011/0221326 A1 * 9/2011 Preston ..... H01J 65/044 313/113

(Continued)

FOREIGN PATENT DOCUMENTS

EP 0 186 348 A2 7/1986
EP 1770757 A2 * 4/2007 ..... H01J 65/044

(Continued)

*Primary Examiner* — Tung X Le
*Assistant Examiner* — Srinivas Sathiraju
(74) *Attorney, Agent, or Firm* — Birch, Stewart, Kolasch & Birch, LLP

(57) ABSTRACT

A lighting apparatus having a magnetron configured to generate microwaves, a waveguide including a wave guide space configured to introduce and guide the microwaves and an aperture to discharge the microwaves, a resonator to which the microwaves are transmitted through the aperture, and a bulb located in the resonator, the bulb encapsulating a light emitting material and configured to emit light based on the transmitted microwaves is provided. The apparatus also includes a reflective member or optical member located in the resonator such that light emitted from the bulb towards the aperture is reflected away from the aperture.

17 Claims, 7 Drawing Sheets

(56) References Cited

U.S. PATENT DOCUMENTS

2011/0285286 A1* 11/2011 Neate ..... H01J 65/044 315/34
2011/0285287 A1* 11/2011 Neate ..... H01J 65/044 315/34
2011/0309744 A1* 12/2011 Preston ..... H01J 65/044 315/34
2012/0212128 A1* 8/2012 DeVincentis ..... H05B 41/24 315/34
2012/0217871 A1* 8/2012 Lapatovich ..... H01J 65/044 315/34
2012/0217872 A1* 8/2012 Eeles ..... H01J 65/044 315/34
2012/0242223 A1* 9/2012 Espiau ..... H01J 65/042 315/34
2014/0132153 A1* 5/2014 Kim ..... H01J 7/46 315/39
2014/0167607 A1* 6/2014 Kang ..... H01J 9/38 315/39
2014/0197729 A1* 7/2014 Neate ..... H01J 65/044 315/39
2015/0155155 A1* 6/2015 Kim ..... H01J 65/044 315/39
2015/0200084 A1* 7/2015 Kim ..... H01J 65/044 315/39.51
2015/0214022 A1* 7/2015 Kim ..... H01J 61/523 315/248
2015/0214023 A1* 7/2015 Kim ..... H05B 41/2806 315/248

FOREIGN PATENT DOCUMENTS

JP 2005-129408 A 5/2005
JP 2005-285349 A 10/2005
WO WO 03/107725 A1 12/2003

* cited by examiner

LIGHTING APPARATUS

Pursuant to 35 U.S.C. §119(a), this application claims the benefit of Korean Patent Application No. 10-2012-0127116, filed on Nov. 12, 2012, which is hereby incorporated by reference as if fully set forth herein.

BACKGROUND OF THE INVENTION

1. Field of the Invention

The present invention relates to a lighting apparatus and, more particularly, to a lighting apparatus that emits light using microwave source energy.

2. Discussion of the Related Art

Generally, a microwave discharge lamp is an apparatus that applies microwaves to an electrode-less plasma bulb to generate visible light using microwaves at frequencies of hundreds of MHz to several GHz. The microwave discharge lamp has greater brightness and efficiency than an incandescent lamp and a fluorescent lamp, and is increasingly used. An electrode-less discharge lamp is a type of microwave discharge lamp that uses an inactive gas encapsulated in an electrode-less quartz globe (bulb). Almost all modern microwave discharge lamps are configured to emit a continuous spectrum of visible light through high pressure sulfur discharge.

A related art microwave discharge lamp includes a magnetron configured to generate microwaves, a bulb encapsulating a light emitting material to generate light using the microwaves, a resonator for resonation of the microwaves, in which the bulb is located, and a waveguide connecting the magnetron and the resonator to each other.

The light emission principle of the microwave discharge lamp will now be described in brief. Microwaves generated in the magnetron are transmitted to the resonator through the waveguide and, in turn, the microwaves introduced into the resonator excite the light emitting material in the bulb via resonation thereof within the resonator. As the light emitting material filling the bulb is converted into plasma, light is generated and emitted outwardly from the resonator.

An aperture for microwave transmission is provided between the waveguide and the resonator. The aperture is located in a resonance space within the resonator. When light is emitted by the bulb, the light may be introduced into the waveguide through the aperture, which may deteriorate luminous efficacy of the microwave discharge lamp.

In addition, simultaneously with introduction of light into the waveguide, radiant heat generated by the bulb may be transferred to the magnetron through the waveguide. The radiant heat raises a temperature of the magnetron, thus reducing magnetron lifespan.

Therefore, there is a demand for configurations to enhance luminous efficacy of the microwave discharge lamp and to increase magnetron lifespan.

SUMMARY OF THE INVENTION

Accordingly, the present invention is directed to a lighting apparatus that substantially obviates one or more problems due to limitations and disadvantages of the related art.

An object of the present invention is to provide a lighting apparatus that may enhance luminous efficacy and increase magnetron lifespan.

Another object of the present invention is to provide a lighting apparatus that may concentrate an electric field of microwaves on a bulb.

Another object of the present invention is to provide a lighting apparatus that may enhance start-up characteristics.

A further object of the present invention is to provide a lighting apparatus that may alleviate electrical shock of a magnetron upon initial discharge.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a lighting apparatus includes a magnetron configured to generate microwaves, a waveguide including a wave guide space for introduction and guidance of the microwaves and an aperture for discharge of the microwaves, a resonator to which the microwaves are transmitted through the aperture, a bulb received within the resonator, the bulb encapsulating a light emitting material, and a reflective member extending from the waveguide into the resonator to surround a partial region of the aperture, in order to reflect light, emitted by the bulb to the aperture, into the resonator.

The reflective member may be located in a path of light emitted by the bulb to the aperture.

The reflective member may extend from a partial region of the waveguide defining a resonance space of the resonator, so as to be located in a path of light emitted by the bulb to the aperture.

The reflective member may extend from the aperture into the resonator to define a slot between the reflective member and the aperture, and the microwaves may be transmitted into the resonator through the aperture and the slot.

The resonator may have a first face facing the aperture, and a second face extending from the first face to the waveguide, and the slot may be located to face the second face of the resonator.

The reflective member may extend such that an angle between a normal line of the slot and a normal line of the aperture is 90 degrees or more.

The reflective member may include a first member located in a path of light emitted by the bulb to the aperture, and second and third members extending from opposite sides of the first member to the aperture.

The slot may be defined by the first member, the second member, and the third member.

The first member may be convex or concave toward the aperture, and the first member may include a planar portion.

The slot and the aperture may have the same cross sectional area.

The slot and the aperture may have the same length and the same width.

The reflective member may reflect radiant heat emitted by the bulb to the aperture.

In accordance with another aspect of the present invention, a lighting apparatus includes a magnetron configured to generate microwaves, a waveguide including a wave guide space for introduction and guidance of the microwaves and an aperture for discharge of the microwaves, a resonator to which the microwaves are transmitted through the aperture, the resonator having a first face facing the aperture, and a second face extending from the first face to the waveguide, a bulb received within the resonator, the bulb encapsulating a light emitting material, and an optical member located in a path of light emitted by the bulb to the aperture, the optical member having a reflective surface facing the bulb and a guiding surface facing the aperture.

Here, the light, emitted by the bulb to the aperture, is reflected by the reflective surface, and the microwaves, transmitted through the aperture, are emitted to the second face of the resonator by the guiding surface.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Figure 1:
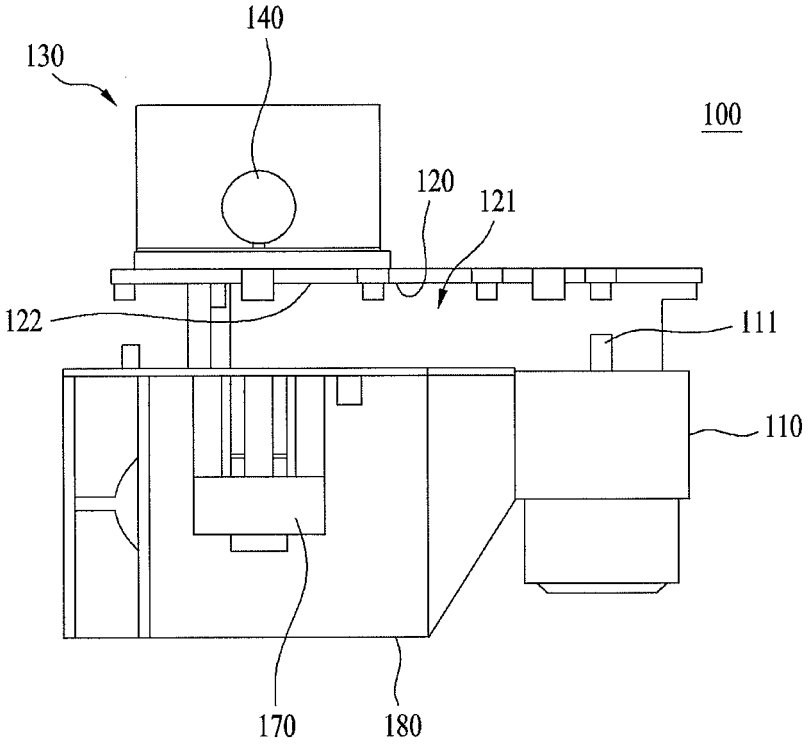
FIG. 1 is a plan view showing an inner configuration of a lighting apparatus according to an embodiment of the present invention.
Figure 2:
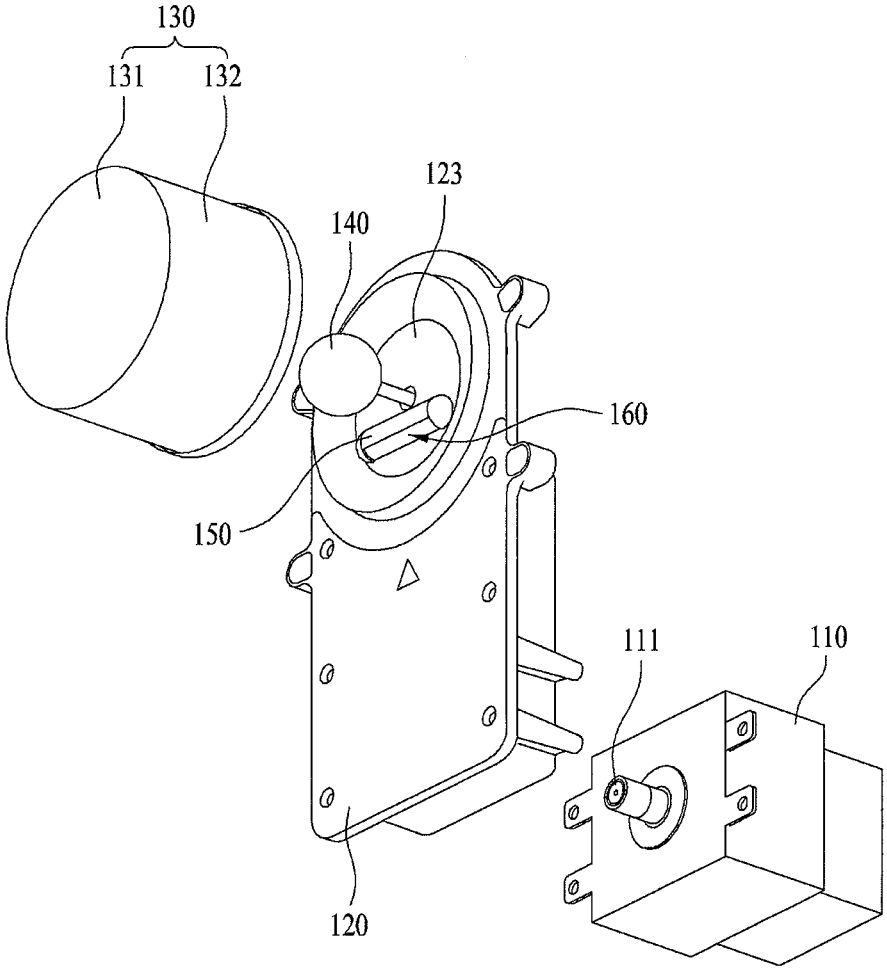
FIG. 2 is an exploded perspective view of the lighting apparatus shown in FIG. 1.
Figure 3:
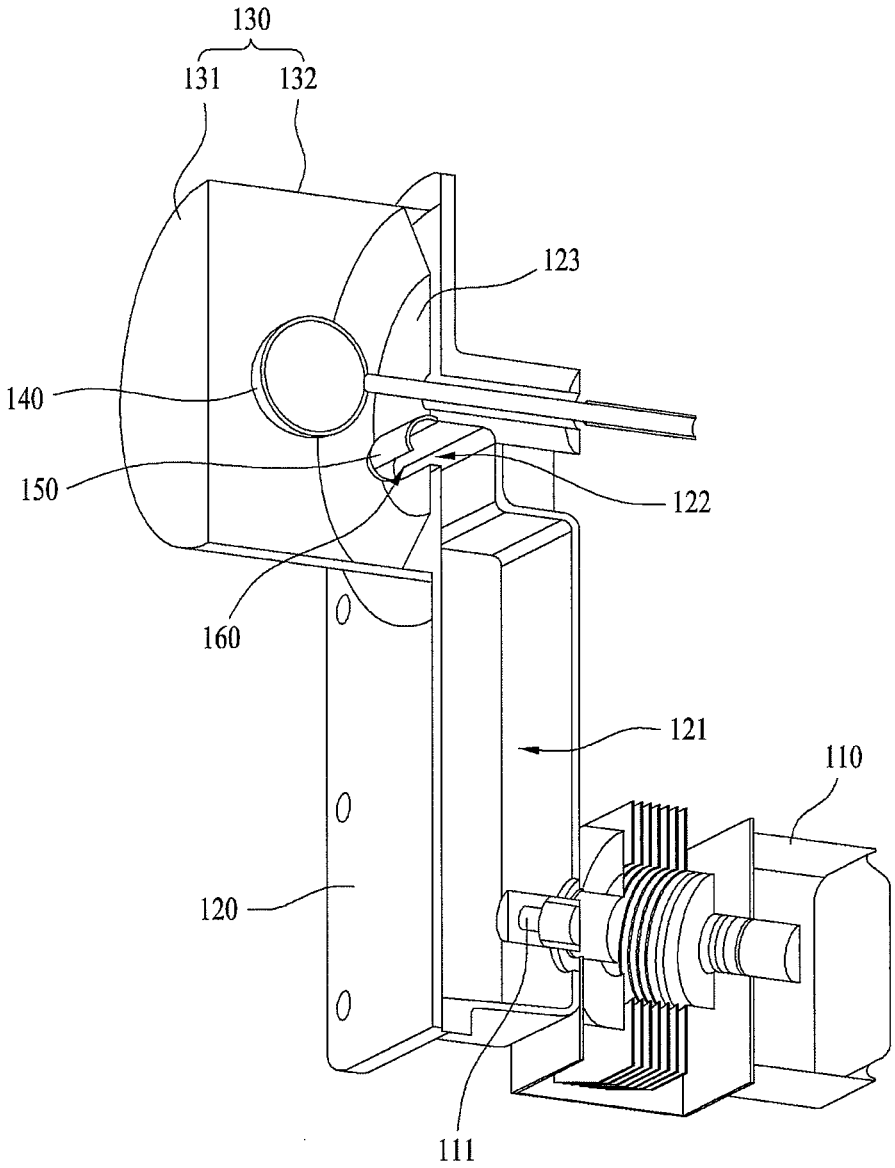
FIG. 3 is a partial cut-away perspective view showing an assembled state of components shown in FIG. 2.

Hereinafter, a lighting apparatus according to embodiments of the present invention will be described in detail with reference to the accompanying drawings. The accompanying drawings show non-limiting examples of various configurations of the present invention and are provided for more detailed explanation of the present invention; however the technical spirit of the present invention is not limited thereto.

In addition, the same or similar elements are denoted by the same reference numerals even though they are depicted in different drawings, and a repeated description thereof will be omitted. In the drawings, for convenience of explanation, sizes and shapes of respective constituent members may be enlarged or reduced.

While the terms first, second, etc. may be used herein to describe various components, these components are not limited by these terms. These terms are used simply to discriminate any one component from other components.

FIG. 1 is a plan view showing an inner configuration of a lighting apparatus according to an embodiment of the present invention.

The lighting apparatus 100 according to an embodiment of the present invention is adapted to emit light using microwaves and, thus, may be referred to as a microwave discharge lamp.

Referring to FIG. 1, the lighting apparatus 100 includes a magnetron 110 configured to generate microwaves, a waveguide 120 which includes a wave guide space 121 for introduction and guidance of the microwaves and an aperture 122 for discharge of the microwaves, a resonator 130 to which the microwaves are transmitted through the aperture 122, a bulb 140 which is received within the resonator 130 and encapsulated with a light emitting material, and a reflective member 150 which extends from the waveguide 120 into the resonator 130 to surround a partial region of the aperture 122 in order to reflect light emitted by the bulb 140 toward the aperture 122 away from the aperture 122. The reflective member 150 extends from a partial region 123 of the waveguide 120 defining a resonance space of the resonator 130 so as to be located in a path of light emitted by the bulb 140 towards the aperture 122. Hereinafter, the respective components of the lighting apparatus 100 will be described in detail with reference to the accompanying drawings.

The magnetron 110 generates microwaves of a predetermined frequency and a high voltage generator may be integrated with, or be separately formed from, the magnetron 110. The high voltage generator generates a high voltage and the magnetron 110 generates high frequency microwaves upon receiving the high voltage generated by the high voltage generator.

The waveguide 120 includes the wave guide space 121 for guidance of the microwaves generated by the magnetron 110 and the aperture 122 for transmission of the microwaves to the resonator 130. An antenna 111 of the magnetron 110 is inserted into the wave guide space 121. The microwaves are guided along the wave guide space 121 and are, thereafter, discharged into the resonator 130 through the aperture 122.

The resonator 130 functions to shield outward discharge of the microwaves introduced therein to create a resonance mode and to generate a strong electric field via excitation of the microwaves. The resonator 130 may have a mesh shape.

The resonator 130 has a first face 131 facing the aperture 122 and a second face 132 extending from the first face 131 toward the waveguide 120. In this embodiment, the second face 132 has a cylindrical shape. The resonator 130 is mounted to the waveguide 120 to allow the microwaves to be introduced into the resonator 130 to pass only through the aperture 122.

The bulb 140, which is filled with the light emitting material, is received within the resonator 130. The bulb 140 may have a rotating shaft mounted to a motor 170. In addition, in FIG. 1, the lighting apparatus 100 includes a housing 180 surrounding the motor 170.

The light emission principle of the lighting apparatus 100 of a microwave discharge lamp will now be briefly described. Microwaves generated in the magnetron 110 are transmitted to the resonator 130 through the wave guide space 121 of the waveguide 120 and, in turn, the microwaves introduced into the resonator 130 excite the light emitting material in the bulb 140 via resonation thereof within the resonator 130. As the light emitting material filling the bulb 140 is converted into plasma, light is generated and emitted outwardly from the resonator 130. Here, the light emitting material may be constituted of one or more selected from a group consisting of sulfur, calcium bromide ($CaBr_2$), lithium iodide (LiI), and indium bromide (InBr).

The lighting apparatus 100 may include a semispherical reflective shade (not shown) to control the direction of light emitted by the bulb 140 to guide the light outwardly.

In this embodiment, some light (L) emitted by the bulb 140 is directed to the aperture 122 of the waveguide 120. If the light (L) were to be introduced into the waveguide 120 through the aperture 122, rather than being outwardly emitted from the lighting apparatus 100, the lighting apparatus 100 would suffer from light loss, thus having deteriorated luminous efficacy. Accordingly, the lighting apparatus 100 includes the reflective member 150, which surrounds at least a portion of the aperture 122 to reflect the light (L) into the resonator 130 in order to allow the light (L) to be emitted outwardly from the resonator 130. In this configuration, the reflective member 150 is located in a path of the light (L) emitted by the bulb 140 towards the aperture 122.

In addition, the reflective member 150 extends from the aperture 122 into the resonator 130 such that a slot 160 is defined between the reflective member 150 and the aperture 122. The reflective member 150 allows the microwaves to sequentially pass through the aperture 122 and the slot 160 to thereby be transmitted into the resonator 130.

Figure 4:
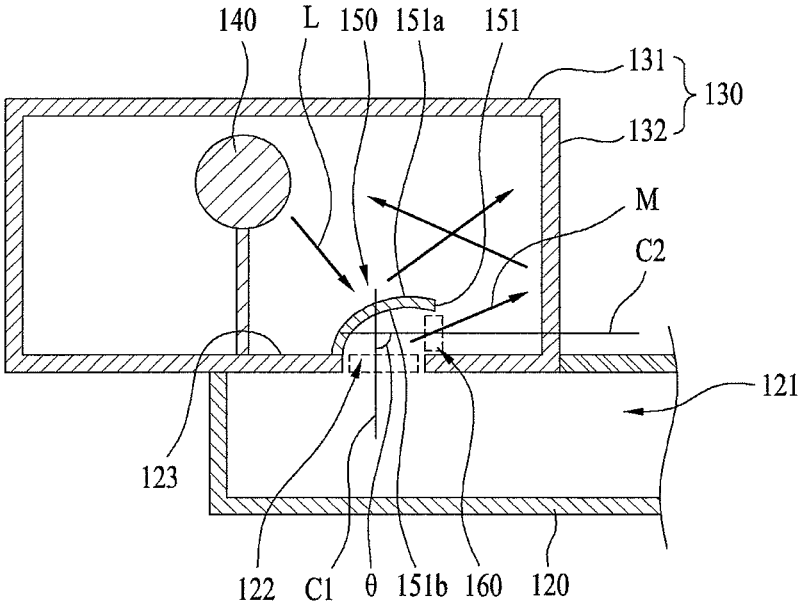
FIG. 4 is a conceptual view for explanation of an operating mode of the lighting apparatus according to an embodiment of the present invention.
Figure 5:
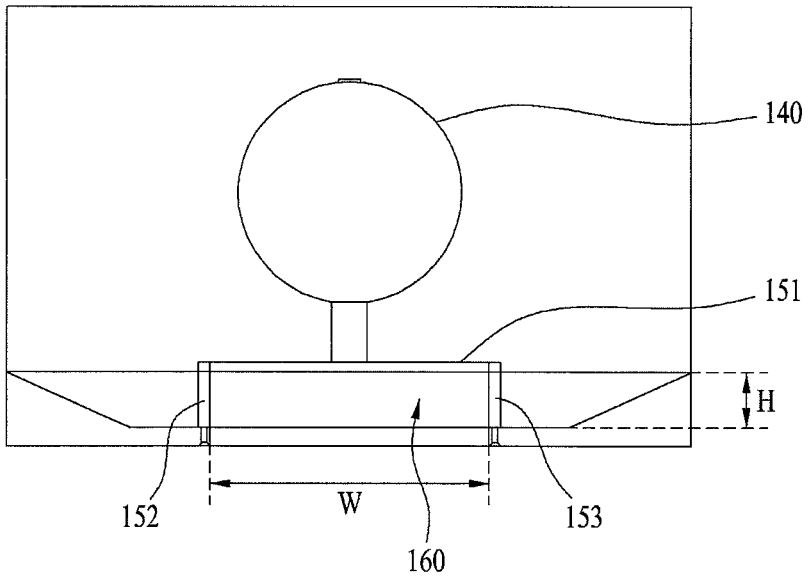
FIG. 5 is a front view of a slot included in the lighting apparatus according to an embodiment of the present invention.

Referring to FIGS. 4 and 5, the reflective member 150 includes a first member 151 located in a path of light emitted by the bulb 140 toward the aperture 122 and second and third members 152 and 153 extending from opposite sides, respectively, of the first member 151 to the aperture 122. The first member 151, the second member 152 and the third member 153 extend from a particular region of the aperture 122 to an inner space of the resonator 130 and are configured to surround the aperture 122. The slot 160 is defined by the first member 151, the second member 152, and the third member 153.

In this embodiment, the microwaves (M) are guided through the wave guide space 121 of the waveguide 120 to pass through the aperture 122. Thereafter, the microwaves (M) may be transmitted into the resonator 130 through only the slot 160 defined by the first member 151, the second member 152 and the third member 153.

As described above, because the microwaves (M) are transmitted into the resonator 130 through the aperture 122, the reflective member 150 surrounding the aperture 122 functions to reflect the light (L) into the resonator 130 and to guide the microwaves (M) transmitted through the aperture 122 into the resonator 130. That is, the reflective member 150 may perform at least two functions to reflect the light (L) and to guide the microwaves (M) into the resonator 130. The reflective member 150 may be referred to as an optical member. The optical member 150 is located in a path of the light (L) emitted by the bulb 140 to the aperture 122 of the waveguide 120 and has a reflective surface 151 a facing the bulb 140 and a guiding surface 151*b* facing the aperture 122 of the waveguide 120.

In this embodiment, the first face 131 of the resonator 130 faces the aperture 122. The slot 160 is preferably located to face the second face 132 of the resonator 130. That is, the optical member 150 functions to guide emission of the microwaves (M), first introduced through the aperture 122 of the waveguide 120, towards the second face 132 of the resonator 130.

As described above, the reflective member 150 may extend from the partial region 123 of the waveguide 120 defining the resonance space of the resonator 130 so as to be located in a path of light emitted by the bulb 140 to the aperture 122 and the partial region 123 of the waveguide 120 faces the first face 131 of the resonator 130. The partial region 123 may define a bottom of the resonance space in which the aperture 122 is located.

As seen in FIG. 4, the reflective member 150 extends in such a way that an angle θ between a line C2 normal to the slot 160 and a line C1 normal to the aperture 122 of the waveguide 120 is 90 degrees or more. For example, the aperture 122 may be positioned to face the first face 131 of the resonator 130 and the slot 160 may be positioned to face the second face 132 of the resonator 130. In this arrangement, the angle θ between the line C2 normal to the slot 160 and the line C1 normal to the aperture 122 of the waveguide 120 is preferably 90 degrees (a right angle) or more than 90 degrees.

Figure 7:
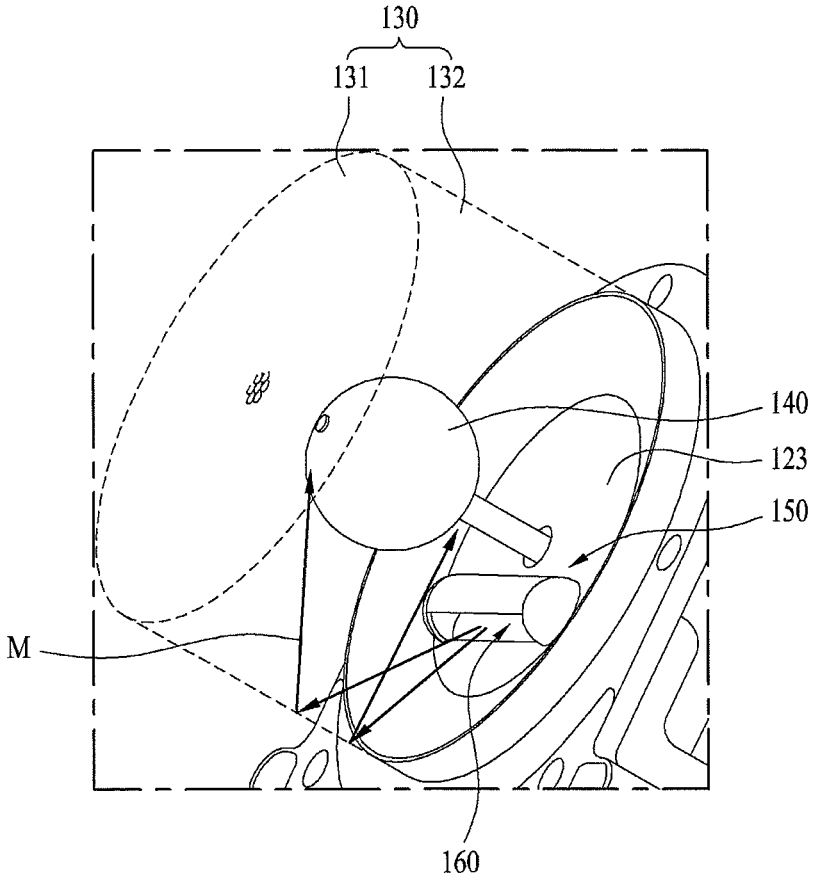

Referring to FIGS. 4 and 7, the microwaves (M) emitted into the resonator 130 through the slot 160 are focused upon the bulb 140 after being reflected from the second face 132 of the resonator 130. If the slot 160 is not positioned to face the second face 132 of the resonator 130, a predetermined time is required until the microwaves (M) emitted into the resonator 130 through the slot 160 are focused upon the bulb 140 and additional time to concentrate an electric filed on the bulb 140 is required. This causes deterioration in initial start-up characteristics of the lighting apparatus 100.

Similarly, if the reflective member 150 is not provided and only the aperture 122 of the waveguide 120 exists, a predetermined time is required until the microwaves having passed through the aperture 122 of the waveguide 120 are focused upon the bulb 140 and additional time to concentrate an electric filed on the bulb 140 is required. This would also cause deterioration in initial start-up characteristics of the lighting apparatus 100.

Accordingly, in this embodiment, positions of the reflective member 150 and the slot 160 are determined such that the microwaves (M) transmitted through the aperture 122 and the slot 160 are focused upon the bulb 140 after being reflected by the second face 132 of the resonator 130 and an electric field may be concentrated on the bulb 140 more quickly, thereby resulting in enhanced start-up characteristics.

Figure 6:
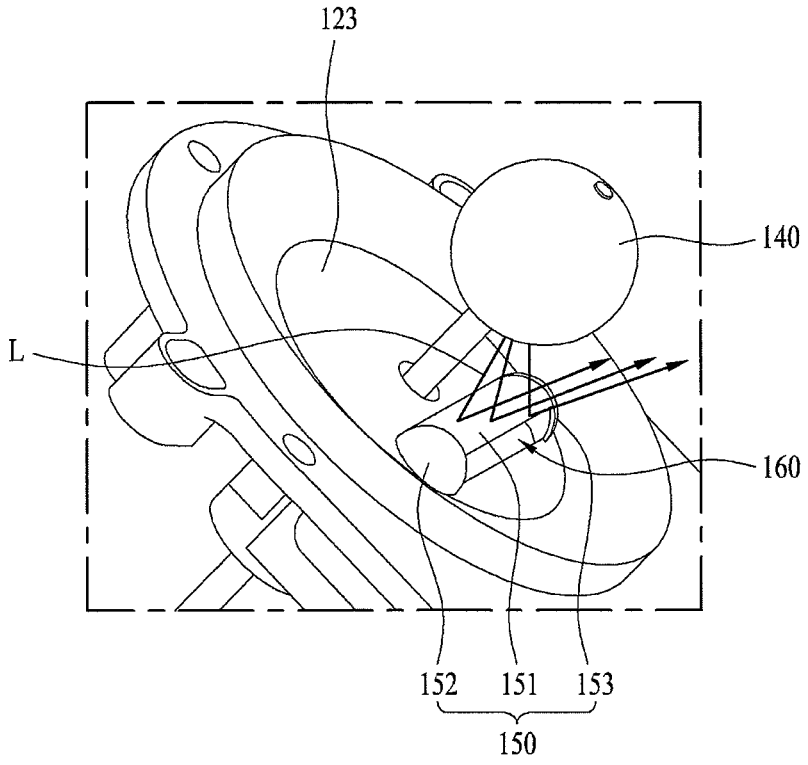
FIGS. 6 and 7 are perspective views for explanation of an operating mode of the lighting apparatus according to an embodiment of the present invention.

Referring to FIGS. 4 and 6, the first member 151 of the reflective member 150 may be shaped to be concave or convex with respect to the aperture 122 of the waveguide 120. The shape of the first member 151 may have an effect on a reflection path of light emitted by the bulb 140 and the shape of the first member 150 may be determined in various ways in consideration of the direction of light emitted outwardly from the resonator 130. Alternatively, the first member 151 of the reflective member 150 may include a planar portion or the first member 151 may have a complex configuration including at least two of a planar portion, a convex portion, and a concave portion.

The slot 160 and the aperture 122 of the waveguide 120 may have the same cross sectional area. In addition, the slot 160 and the aperture 122 may have the same length (W) and the same width (H).

In addition to reflecting light emitted by the bulb 140 toward the aperture 122, radiant heat emitted by the bulb 140 towards the aperture 122 may be reflected by the reflective member 150. Similar to problems with light emitted by the bulb 140 toward the aperture 122 being introduced into the waveguide 120 through the aperture 122, which deteriorates luminous efficacy of the lighting apparatus 100, if the radiant heat (infrared light) emitted by the bulb 140 to the aperture 122 is introduced into the waveguide 120, the radiant heat raises a temperature of the magnetron 110, thus reducing lifespan of the magnetron 110.

One approach to solve these problems could be to mount a mirror at the aperture 122. However, the mirror may be easily damaged because the radiant heat emitted by the bulb 140, which would be inconvenient due to periodic replacements of the mirror and increased maintenance costs. Accordingly, provision of the reflective member 150 that redirects radiant heat emitted by the bulb 140 toward the outside of the lighting apparatus 100 may increase lifespan of the magnetron 110.

Experiments may be implemented in order to verify increase in the luminous flux of light emitted outwardly from the lighting apparatus 100 by the reflective member 150. The experimental conditions were set to include an outer surface of the bulb 140 defined as a light source, a light emission direction set to a radial direction, a surface reflectance of the reflective member 150 set to 100%, a light receiving plane having an area of 500 m*500 m located a distance of 0.5 m in a line normal to the slot 160 from the center of the bulb 140, and a quantity of light emitted by the bulb 140 set to 1000 lm. It was confirmed from experimental results that the quantity of light was 733.55 lm measured from a lighting apparatus not provided with the reflective member 150 while the quantity of light of 764.44 lm was measured from the lighting apparatus 100 provided with the reflective member 150. The luminous flux was increased by about 3.5%.

As is apparent from the above description, a lighting apparatus according to an embodiment of the present invention may enhance luminous efficacy and increase magnetron lifespan.

Further, a lighting apparatus according to an embodiment of the present invention may concentrate an electric field of microwaves on a bulb and enhance start-up characteristics.

Furthermore, a lighting apparatus according to an embodiment of the present invention may alleviate electrical shock of a magnetron upon initial discharge.

It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

What is claimed is:

1. A lighting apparatus comprising:

a magnetron configured to generate microwaves;

a waveguide including:

a wave guide space configured to introduce and guide the microwaves from the magnetron; and an aperture to discharge the microwaves from the wave guide;

a resonator to which the microwaves are transmitted through the aperture;

a bulb located in the resonator, the bulb encapsulating a light emitting material and being configured to emit light in response to the transmitted microwaves; and a reflective member located in the resonator to at least partially cover a portion of the aperture such that light emitted from the bulb towards the aperture is reflected away from the aperture, wherein the reflective member extends from the aperture into the resonator and defines a slot between the reflective member and the aperture, and the microwaves are transmitted into the resonator through the aperture and the slot, wherein the reflective member includes:

a first member located in the path of light emitted by the bulb toward the aperture; and second and third members extending from opposite sides of the first member, respectively, to the aperture, and wherein the slot is defined by the first member, the second member and the third member.

2. The apparatus according to claim 1, wherein the reflective member extends from the waveguide into the resonator.

3. The apparatus according to claim 2, wherein a region of the waveguide and the resonator define a resonance space, and wherein the reflective member extends from the region of the waveguide so as to be located in a path of light emitted by the bulb toward the aperture.

4. The apparatus according to claim 1, wherein the resonator has a first face facing the aperture and a second face extending from the first face to the waveguide, and wherein the slot is located to face the second face of the resonator.

5. The apparatus according to claim 1, wherein the reflective member is formed such that an angle between a line normal to the slot and a line normal to the aperture is 90 degrees or more.

6. The apparatus according to claim 1, wherein the first member is shaped to be convex or concave with respect to the aperture.

7. The apparatus according to claim 1, wherein the first member includes a planar portion.

8. The apparatus according to claim 1, wherein the slot and the aperture have a same cross sectional area.

9. The apparatus according to claim 8, wherein the slot and the aperture have a same length and a same width.

10. The apparatus according to claim 1, wherein the reflective member is configured such that radiant heat emitted by the bulb toward the aperture is reflected by the reflective member.

11. The apparatus according to claim 1, wherein the waveguide and the reflective member are formed of a same material.

12. The apparatus according to claim 1, wherein the reflective member surrounds the aperture to allow microwaves, having passed through the aperture, to be emitted into the resonator only through the slot.

13. The apparatus according to claim 12, wherein the resonator has a first face facing the aperture and a second face extending from the first face to the waveguide, and wherein the slot is positioned to face the second face of the resonator.

14. The apparatus according to claim 13, wherein the microwaves emitted into the resonator through the slot are focused upon the bulb after being reflected by the second face of the resonator.

15. A lighting apparatus comprising:

a magnetron configured to generate microwaves;

a wave guide space configured to introduce and guide the microwaves from the magnetron; and an aperture to discharge the microwaves from the wave guide;

a resonator to which the microwaves are transmitted through the aperture;

a bulb located in the resonator, the bulb encapsulating a light emitting material and being configured to emit light in response to the transmitted microwaves; and an optical member located in a path of light emitted by the bulb toward the aperture, the optical member having a reflective surface facing the bulb and a guiding surface facing the aperture, wherein the light emitted by the bulb toward the aperture is reflected by the reflective surface away from the aperture, wherein the microwaves transmitted through the aperture are directed toward the resonator by the guiding surface, wherein the optical member extends from the aperture into the resonator and defines a slot between the optical member and the aperture, and the microwaves are transmitted into the resonator through the aperture and the slot, wherein the optical member includes:

a first member located in the path of light emitted by the bulb toward the aperture; and second and third members extending from opposite sides of the first member, respectively, to the aperture, and wherein the slot is defined by the first member, the second member and the third member.

16. The apparatus according to claim 15, wherein the resonator has a first face facing the aperture and a second face extending from the first face to the waveguide, and wherein the microwaves transmitted through the aperture are first directed toward the second face of the resonator by the guiding surface.

17. The apparatus according to claim 15, wherein the optical member is formed such that an angle between a line normal to the slot and a line normal to the aperture is 90 degrees or more.

* * * * *